US005823385A

United States Patent [19]

Cautereels

[11] Patent Number: 5,823,385

[45] Date of Patent: Oct. 20, 1998

[54] CONTAINER WITH TWO POSITION HANDLE

[75] Inventor: Victor J. J. Cautereels, Ranst, Belgium

[73] Assignee: Dart Industries Inc., Orlando, Fla.

[21] Appl. No.: 832,541

[22] Filed: Apr. 3, 1997

[51] Int. Cl.[6] ..... B65D 25/00

[52] U.S. Cl. ..... 220/762; 220/764; 220/766

[58] Field of Search ..... 220/762, 763, 220/764, 765, 766

[56] References Cited

U.S. PATENT DOCUMENTS

| | | | |
|---|---|---|---|
| D. 267,545 | 1/1983 | Mineo . | |
| D. 323,758 | 2/1992 | Hoelterscheidt . | |
| D. 347,962 | 6/1994 | Tardif . | |
| D. 359,196 | 6/1995 | Nichols . | |
| 584,718 | 6/1897 | Witcher | 220/764 X |
| 874,701 | 12/1907 | O'Neill | 220/763 |
| 1,496,600 | 6/1924 | Rau | 220/764 X |
| 1,586,020 | 5/1926 | Witherspoon . | |
| 1,737,249 | 11/1929 | Kempter | 220/766 X |
| 1,765,072 | 6/1930 | Hashimoto | 220/766 X |
| 2,384,718 | 9/1945 | Witherspoon . | |
| 3,412,887 | 11/1968 | Swartwood et al. | 220/763 X |
| 3,807,594 | 4/1974 | Zimmerman et al. . | |
| 4,505,390 | 3/1985 | Kirk, Jr. | 220/764 X |

*Primary Examiner*—Steven M. Pollard
*Attorney, Agent, or Firm*—John A. Doninger

[57] ABSTRACT

A container having a two position handle with one end of the handle being rotatably received over a post projecting integrally from the container. The handle is selectively and releasably locked into a container-overlying bail position and a pouring position extending along the side of the container. The container is closed by a removable cover threaded within the upper portion of the container and including a radially projecting tab closing the container spout upon a full seating of the cover.

19 Claims, 4 Drawing Sheets

CONTAINER WITH TWO POSITION HANDLE

BACKGROUND OF THE INVENTION

In order to facilitate the handling of containers for fluent materials, for example vacuum bottles, drinking containers, pouring containers, and the like, it is not uncommon for such containers to be provided with a side handle for both carrying and pouring, a bail for assistance in carrying the container, or both, either in the form of separate members or through the provision of an adjustable handle selectively movable between a side handle position and a bail position.

Examples of an adjustable handle will be noted in the following two patents:

U.S. Pat. No. 1,586,020 Witherspoon May 25, 1926

U.S. Pat. No. 2,384,718 Witherspoon Sep. 11, 1945

In each of these patents a rather awkward multiple stage manipulation is required to release the handle from one position, adjust it to the second position, and secure the handle in the second position. While such a series of steps may have been required by the nature of the materials commonly available at the time of the respective inventions, such manipulative steps appear awkward by present day standards and prone to failure at the several areas of separate mechanical manipulation.

SUMMARY OF THE INVENTION

The present invention is concerned with improvements in fluent material containers which, in addition to being practical and economical, provide for a superior product with regard to durability, ease of manipulation and strength.

The container of the invention, which for purposes of illustration has been shown as having a vertically elongate hollow cylindrical body, includes a slightly bulbous upper end portion with a series of concentric ribs or steps annularly thereabout for providing, in conjunction with the bulbous profile, an enhanced gripping area for a direct gripping of the container adjacent the upwardly opening mouth thereof.

The mouth of the container is selectively sealed by a screw-in plug cover having an outwardly extending arcuate tab which, upon a full seating of the cover, aligns over and substantially seals an integral spout at the upper edge portion of the container body. Upon a partial unthreading of the plug cover, and the corresponding movement of the tab away from the spout, the contents can be poured from the container as an alternative to a full removal of the cover. It is also contemplated that the internal thread within the bulbous upper end portion of the body which receives the threaded exterior of the cover be of a single discontinuous arc or flight so related to the cover thread as to ensure a proper positioning of the tab over the spout at a full seating of the cover.

Of further particular significance is the provision of an elongate generally arced handle which rotatably mounts at one end to a pivot post integral with and extending at an outward and upward angle from the upper end portion of the container body. The angle of the post and the general arcuate configuration of the handle allow for rotation of the handle about the post between a first handle or pouring position along the side of the container, and a second position overlying the mouth or closed upper end of the container in the manner of a bail. The handle automatically and releasably locks in each position upon a rotation to that position.

Other features and advantages of the invention will become apparent from the more detailed explanation of the invention following hereinafter.

DESCRIPTION OF PREFERRED EMBODIMENT

Figure 1:
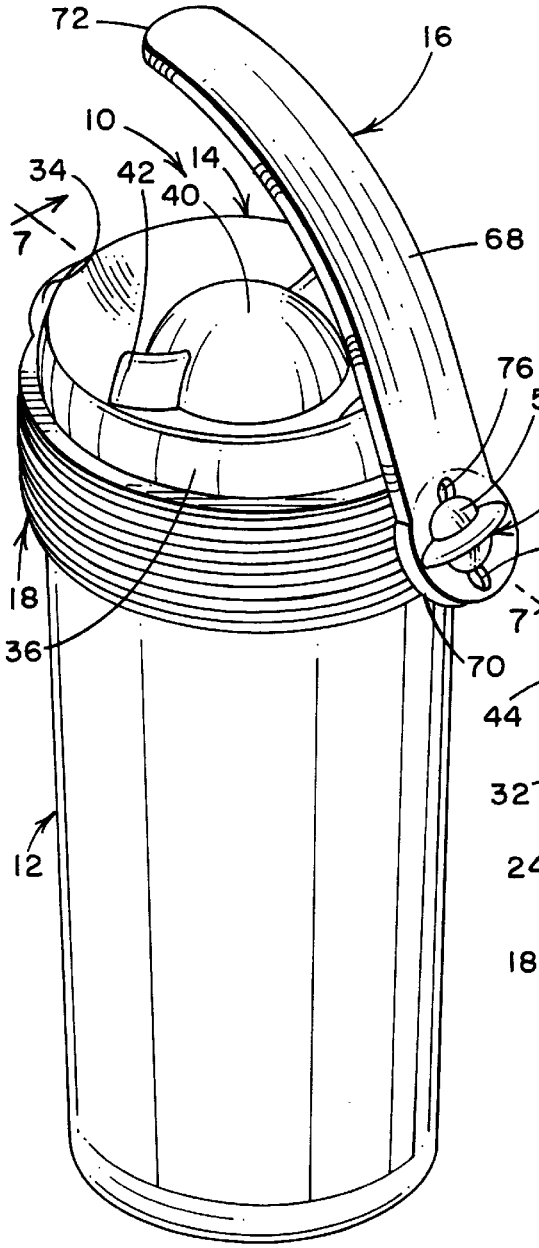
FIG. 1 is a perspective view of the container with the handle in the bail position and the cover fully closed.

Referring now more specifically to the drawings, the container 10 includes a container body 12, a removable cover 14, and an adjustable and removable handle 16.

The container body 12, while not specifically limited thereto, will preferably be of a vertically elongate cylindrical configuration with a closed bottom and an upper end portion 18 defining an upwardly opening mouth 20. The upper end portion is of a generally outwardly convex or bulbous configuration with shallow ribs or steps 22 peripherally thereabout. The bulbous configuration and stepped surface thereon will provide a convenient non-slip gripping area should one wish to grasp the container body 12 directly, for example as the container is being filled. In order to facilitate and control a pouring of the contents of the container body from the interior of the container, the generally bulbous upper end portion 18 will include a pouring spout 24 integrally formed therefrom at and immediately inward from the open mouth 20 of the container body 12. The spout 24 is radially outwardly offset from the upper end portion 18 of the body and is of an upwardly opening generally curvilinear configuration with an upper edge co-extensive with the upper edge of the body defining the mouth 20.

Figure 2:
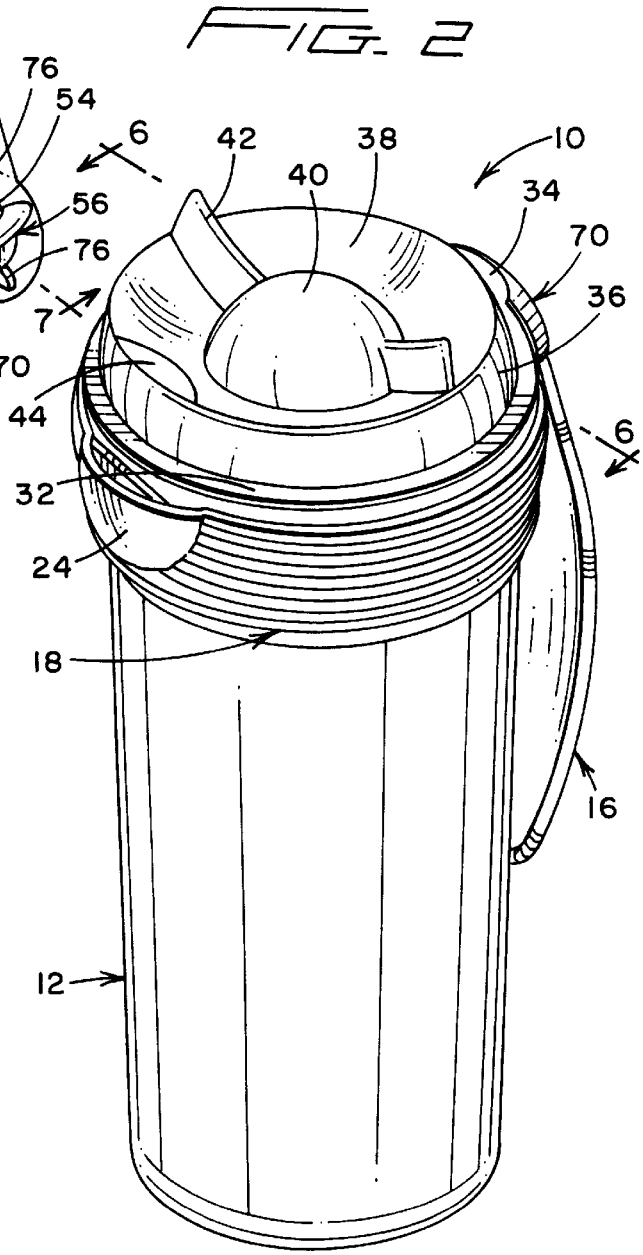
FIG. 2 is a similar perspective view with the handle in the handle or pour position and with the cover partially open.
Figure 3:
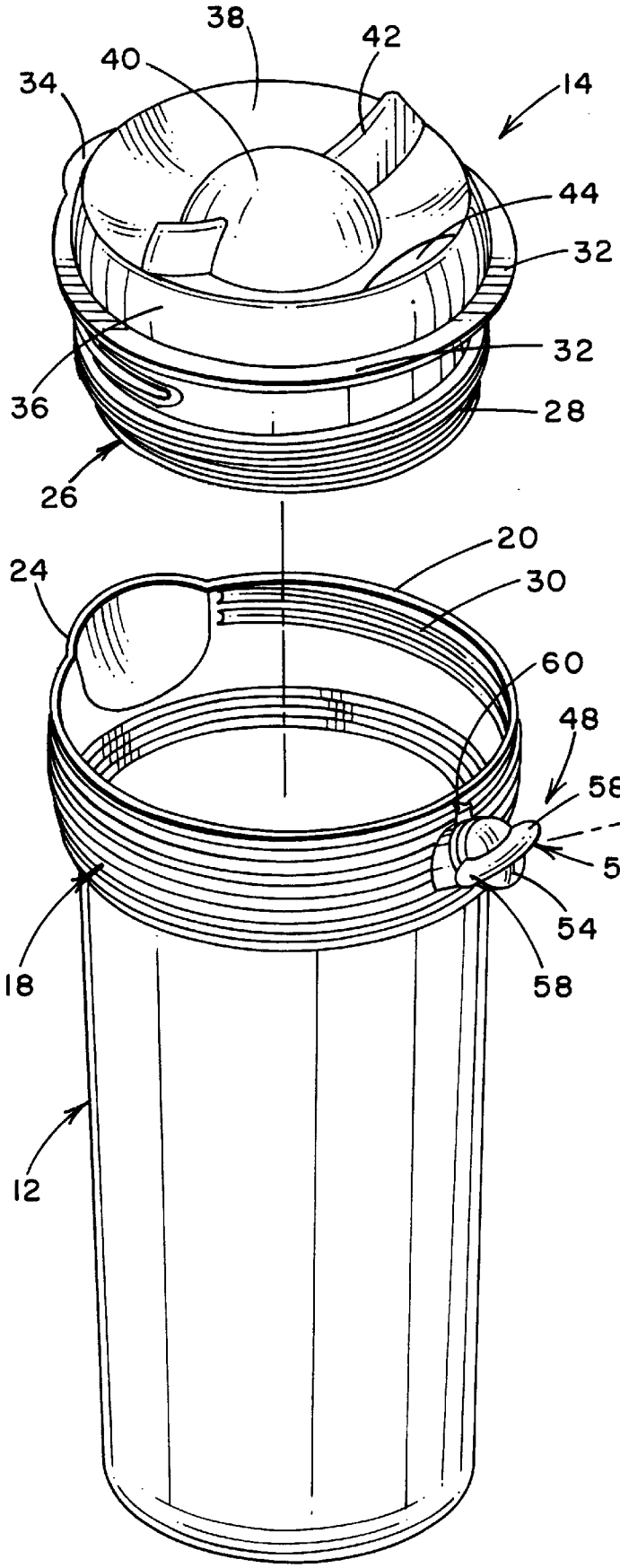
FIG. 3 is an exploded perspective view of the three separate components of the invention.
Figure 4:
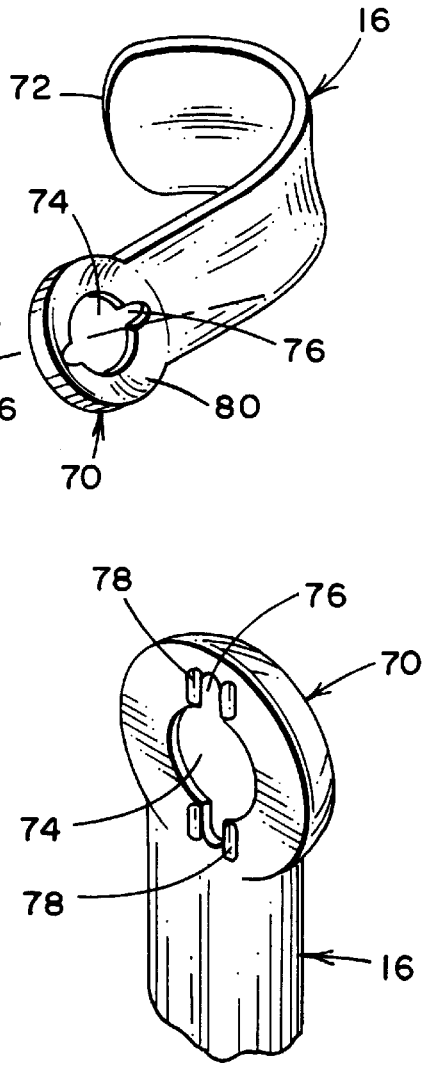
FIG. 4 is an enlarged perspective detail of the mounting end of the handle.

The cover 14 is a plug-type cover with a cylindrical plug portion 26 having a multi-flight thread 28 thereon which threadedly engages with a single partial flight thread 30 on the cylindrical interior of the bulbous upper end portion 18. The cover 14, immediately above the plug portion 26, includes an annular outwardly projecting flange 32 which, upon a full threaded engagement of the plug portion 26, seats snugly on the free upper edge of the body. The flange 32 includes an integral outwardly-extending coplanar tab 34 which is configured and positioned to overlie and close the upwardly opening mouth of the spout 24 upon a full seating of the cover. The tab and spout alignment is achieved by appropriately coordinating the relationship between the plug portion thread 28 and the interrupted thread 30 which has a single lead-in end receiving the single lead-in end of the plug thread 28. Should one wish to pour contents from the container body without a complete removal of the cover, a rotation of the cover approximately 180°, as suggested in FIG. 2, from its fully seated position, will both uncover the spout mouth and provide sufficient clearance between the inner end of the plug portion and the lower end of the spout for a flow of the fluent material from the container.

Figure 6:
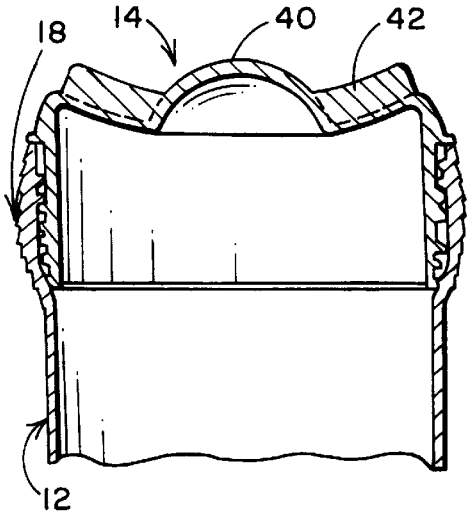
FIG. 6 is a cross-sectional detail of the upper portion of the container taken substantially on a plane passing along line 6—6 in FIG. 2.

The cover 14, above the peripheral seating flange 32, includes an upwardly extending cylindrical wall 36 inwardly offset from the outer periphery of the flange 32 and integrally formed with a concave top panel 38 having, centrally therein, an integral upwardly projecting hemispherical dome 40. Rotational manipulation of the cover 14 is facilitated by a pair of diametrically opposed fins 42 extending from the central dome 40 to the outer peripheral edge of the top panel 38 and generally following the concave curvature of the top panel. This concave configuration of the top panel 38 allows for a convenient recess in which the fingers of the hand can be inserted for engagement with the low profile turning fins 42. The fins 42 at the maximum height thereof, are at or below the high point of the central dome 40. As an alignment aid, the top panel 38 can be provided with indicia or a slight surface recess 44 therein diametrically opposed from the position of the spout-covering tab 34. Finally, noting FIGS. 6 and 7 in particular, the cover, and in particular the depending plug portion 26 thereof, is hollow both so as to save material and to reduce weight. Sufficient strength is of course maintained with the cover stabilized by the concave top panel 38, central dome 40 and turning fins 42.

Figure 5:
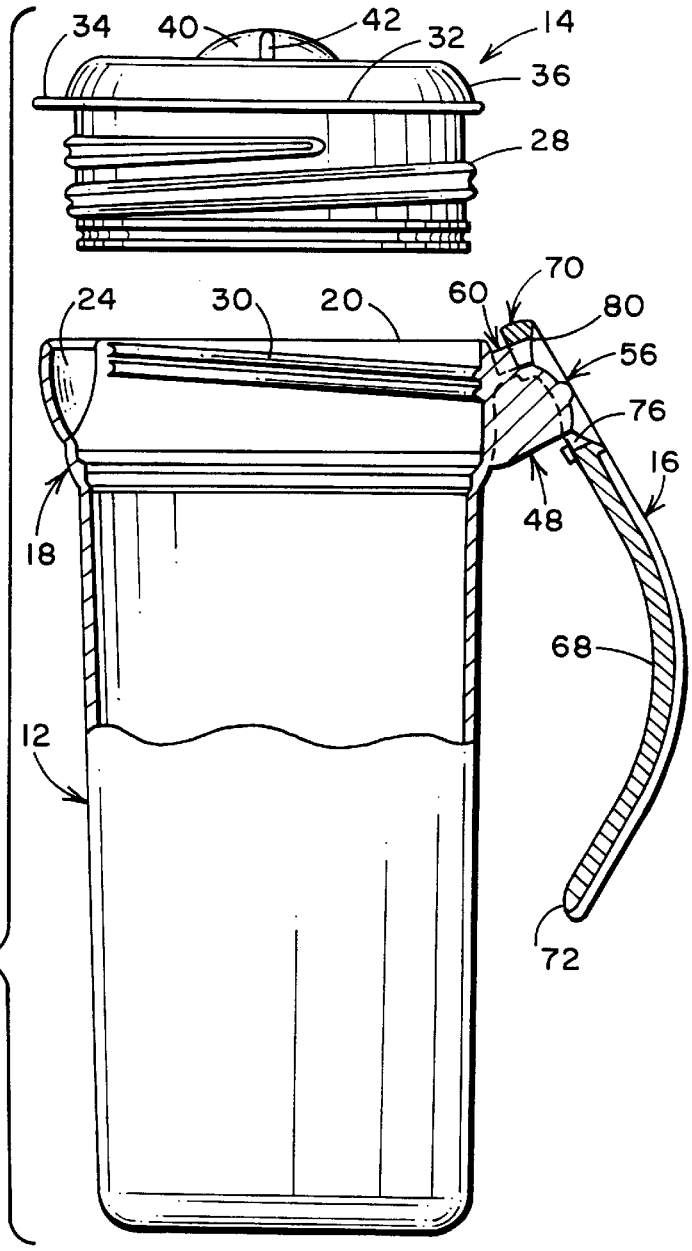
FIG. 5 is an exploded elevational view, partially in section, of the container with the handle in the pouring position.
Figure 7:
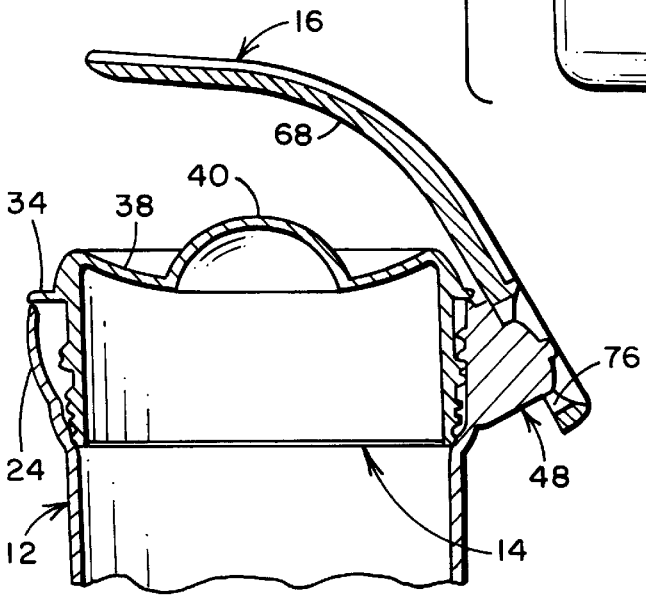
FIG. 7 is a cross-sectional detail of the upper portion of the container taken substantially on a plane passing along line 7—7 in FIG. 1.

The handle 16 mounts to the container body by adjustable and releasable engagement with a mounting or pivot post 48 integral with the upper end portion 18, diametrically opposed to the spout 24, at an upward and outward angle which, in conjunction with the configuration of the handle 16, ensures an optimum positioning of the handle in a first handle position or pouring position, and a second carrying or bail position as respectively illustrated in FIGS. 5 and 7. In the illustrated preferred embodiment, this angle will be substantially 29° to the horizontal.

The post 48 is of a cylindrical configuration with a generally hollow interior and includes an arcuate upper wall 50 which is of an arc greater than 180° to provide a rigid rotating surface for the handle 16. The post is stabilized by an integral central rib 52 which depends from the uppermost point on the arcuate wall 50 to a point immediately inward of the periphery of the cylindrical post 48 as defined by the outer surface of the arcuate upper wall 50.

The post 48 includes an outer slightly domed end wall 54 integrally formed with the post wall 50 and rib 52 and of a diameter corresponding to that of the cylindrical configuration of the post. Integrally formed with the end wall 54 is a forwardly and projecting crossbar 56 having locking ends 58 radially projecting from the end wall 54 at diametrically opposed points with the locking bar positioned generally transversely with regard to the vertical axis of the container body 12.

The post 48 is completed by a locking lug 60 aligned with the central reinforcing rib 52 and both integral with and projecting upwardly from the post forming wall 50 immediately inward of the domed end wall 54. The lug 60, as illustrated, can be of a T-shaped configuration with a stem portion 62 extending along the post outer wall 50 to the upper end portion 18 of the container body, and a relatively wider head 64 at the outer end thereof at the domed end 54 of the post. This outer head 64 has opposed edges which define stops or positioning abutments as shall be explained subsequently.

The handle 16 is elongate with an arcuate central portion 68 on an approximate radius of 72°, the preferred radius being 71.86° with a post angle of 29°. This radius may vary slightly depending upon the preferred positioning of the handle in its two positions, and the specific angle at which the pivot post 48 projects.

The handle 16, to the opposite ends of the arcuate central portion 68, includes substantially linear or straight end portions, one end portion terminating in a first post-engaging end 70, and the second substantially linear end portion terminating in a free end 72. The post-engaging end 70 is circular with a circular opening 74 defined centrally therethrough, forming in effect a flat annular configuration. The opening 74 is of a diameter only slightly greater than the diameter of the post inward of the locking bar 56 for reception on and rotation about the post.

In order to provide for an engagement with the post-engaging end 70 with the post 48, a pair of diametrically opposed recesses 76, aligned with the central axis of the handle, communicate with and extend outward from the opening 74. The recesses are of a size to allow for free passage of the locking ends 58 of the locking bar therethrough upon alignment therewith and inward movement of the engaging end 70 inwardly onto the post 48. After a moving of this engaging end 70 inward beyond the locking bar 56 of the post 48, the handle can be rotated in either direction with the locking ends 58 overlying the outer face of the engaging end 70 at an angular distance from the recesses 74. In this manner, withdrawal of the handle from the mounting post is precluded until the locking ends 58 are again aligned with the recesses 76.

Figure 8:
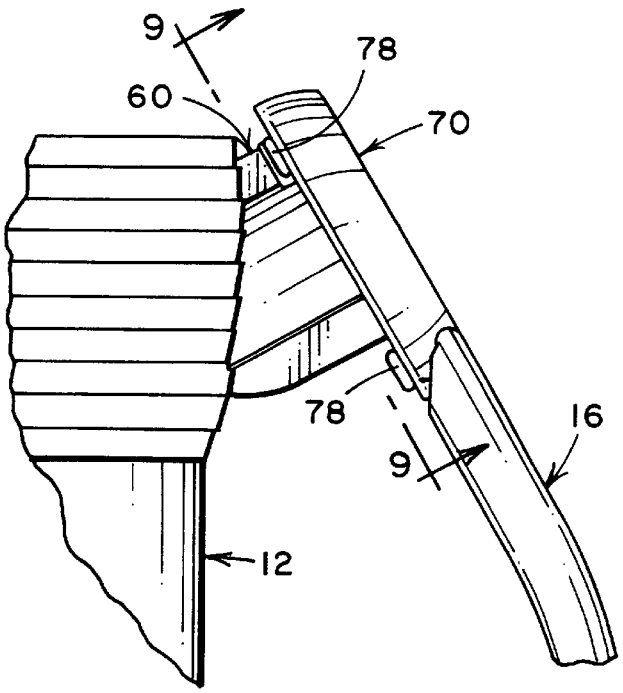
FIG. 8 is an enlarged partial elevational view at the mounted end of the handle in the pouring position.
Figure 10:
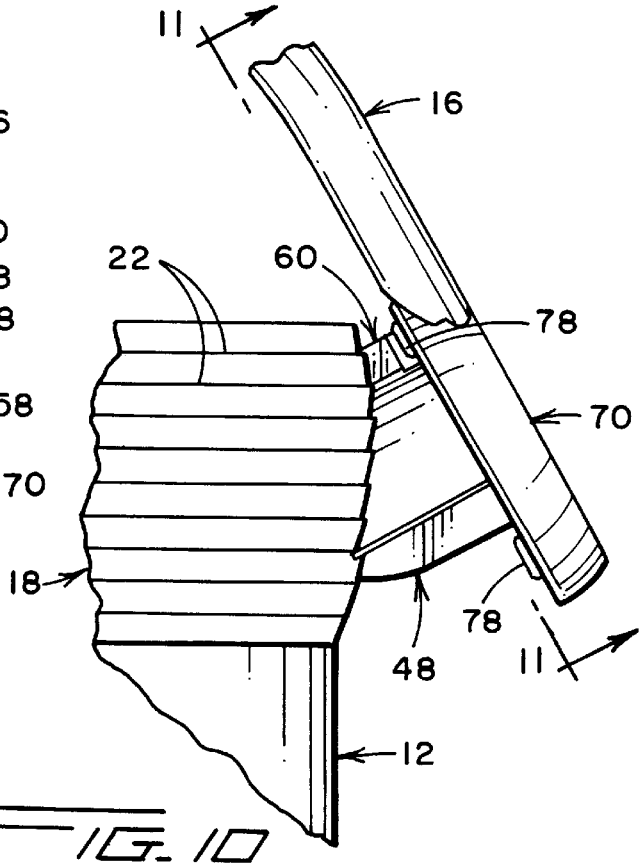
FIG. 10 is an enlarged partial elevational view of the mounted end of the handle in the bail position.

In order to stabilize the handle 16 in each of the two operative positions thereof, the pouring position of FIGS. 5 and 8, and the carrying or bail position of FIGS. 7 and 10, the rear or inner face of the engaging end 70 is provided, immediately adjacent the opposed edges of each recess 76, with integral inwardly projecting positioning lugs 78 which extend from the inner face of the engaging end 70 a sufficient distance as to abut on the opposed side edges of the head 64 of the locking lug 60 mounted on the pivot post 48. As will be recognized, the inner face of the engaging end 70 engages the outer face of the lug head 64 to preclude inward passage of the engaging end 70 therebeyond. In locking the handle 16 in its pouring position, the handle is rotated to extend downward along the body of the container with the outermost pair of positioning lugs 78, through a snap-engagement resulting from a positive manual pressure on the handle, receiving the locking lugs 60 therebetween for a positive retention of the handle in this position. The handle, so positioned, can be used either to carry the container or, more particularly, pour the contents therefrom. The arc of the handle retains the free lower end 72 of the handle in spaced but close proximity to the container body to minimize lateral projection of the handle, while providing ample room for a grasping of the handle. The handle is firmly stabilized in this position by engagement of the locking lugs 60 between the positioning lug 78, and will remain in this position until a positive manual pressure is exerted to rotate the handle away from this position about the pivot post 48. The nature of the synthetic resinous materials from which the handle and container components are formed provides sufficient flexible resiliency, and rigidity to allow for the selective locking engagement required to maintain the handle in the desired positions. To facilitate the engagement, the lugs can have slightly rounded edges In the bail or carrying position of the handle 16, note for example FIGS. 1 and 7, the innermost pair of the positioning lugs 78, upon a rotation of the handle 16, snap engage with the locking lug 60 to position the handle with the substantially linear second end portion thereof extending generally diametrically across the container in upwardly spaced relation thereto, providing in effect an open end handle which can be easily engaged for a lifting and carrying of the container. The arcuate portion of the handle, in conjunction with the linear end portion terminating in the post-engaging end 70, allows for a proper extension of the handle 16 from the post into the desired overlying relationship relative to the container.

Figure 9:
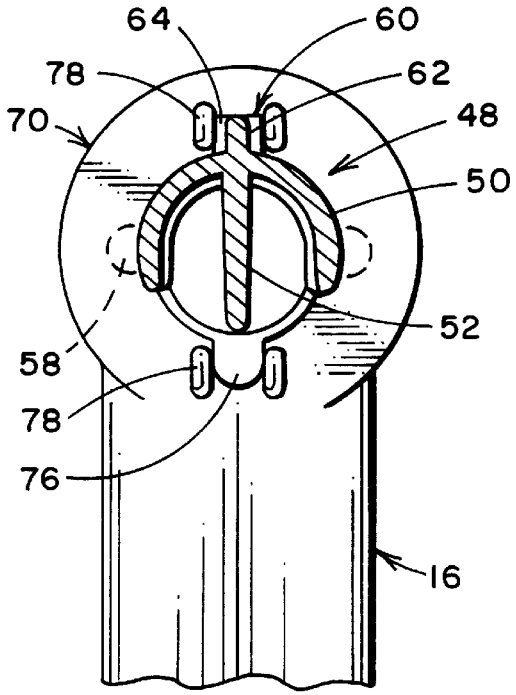
FIG. 9 is a cross-sectional detail taken substantially on a plane passing along 9—9 in FIG. 8.
Figure 11:
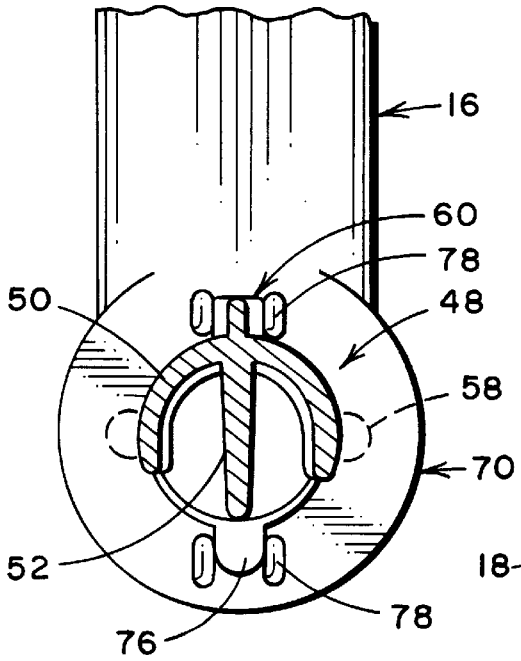
FIG. 11 is a cross-sectional detail taken substantially on a plane passing along line 11—11 in FIG. 10.

The handle 16 is transversely arcuate along the length thereof both for providing additional rigidity and to provide an ergonomically comfortable handle. The outer face 80 of the engaging end 70, noting for example FIG. 5, is concave whereby the locking bar 56 and the opposed ends 58 thereof do not project beyond the outermost plane of the handle, providing a smooth surface. As desired, the undersurfaces of the locking bar ends 58 can be slightly rounded to appropriately sidably seat on this concave surface 80. Noting FIGS. 9 and 11, the width and configuration of the head portion 64 of the locking lug 60 are greater than that of the opening recesses 76 to preclude passage of the locking lug 60 through these recesses when locked between the corresponding pairs of positioning lugs 78.

From the foregoing, it will be appreciated that the invention constitutes a significant forward step in the art with the two-position handle providing for an enhanced handling of the container for both a pouring of the contents therefrom and a general handling and carrying of the container. In addition, the compact positioning of the handle in its bail position substantially reduces the overall width of the container and handle assembly for simplifying a storing thereof, even within the normally narrow confines of a refrigerator door shelf. Of further significance is the ease in which the handle can be manipulated and locked in the two positions thereof, and in fact removed from the container body should such be necessary either for replacement or cleaning purposes.

The foregoing is illustrative of the features of the invention, and while a preferred embodiment has been illustrated, it is to be appreciated that the invention is intended to encompass all related embodiments falling within the scope of the claims appearing hereinafter.

I claim:

1. A container for fluent materials, said container comprising a container body having an upper end portion defining an upwardly opening mouth, an elongate handle having opposed first and second ends, and a post mounted on said container body below said mouth and extending along an axis extending laterally of said container body, said post securing said first end of said handle to said container body selectively in a plurality of adjusted positions relative to said container body, said positions being defined by rotation of said handle about said axis of said post, and said positions extending between a first pouring position in which said handle depends from said post generally adjacent said container body with said second end of said handle being free and below said first end thereof, and a second bail position in which said handle extends upward from said post with said second end of said handle being free and over said upwardly opening mouth in spaced relation above said container body.

2. The container of claim 1 wherein said handle includes a substantially arcuate central portion intermediate said first and second ends thereof, said central portion being outwardly convex relative to said container body in said first and second positions.

3. The container of claim 2 wherein said second end of said handle is outwardly spaced from said body in each of said first and second positions.

4. The container of claim 3 wherein said handle includes generally linear first and second end portions respectively extending between said central portion and said first and second ends, said second end portion, in said second bail position of said handle, extending transversely across said container, said second end of said handle being in vertically spaced relation above said container mouth.

5. The container of claim 4 including means for selectively and releasably locking said first end of said handle to said post in said first and second positions of said handle, and means on said post and said first end of said handle for selectively engaging and releasing said post-engaging end with and from said post at an intermediate position between said first and second positions.

6. The container of claim 5 wherein said means for locking said first end of said handle to said post comprises snap-engaging lugs on said post and on said first end of said handle, said lugs snap-engaging and releasably locking said handle in said first and second positions as said handle is manually moved into said positions.

7. The container of claim 6 wherein said means for selectively engaging and releasing said first end with and from said post comprises a central opening through said first end of said handle for receiving said post axially therethrough, said post having an outer end portion with laterally outwardly extending locking members thereon, said opening through said post-engaging end of said handle having laterally outwardly extending recesses selectively alignable with said locking members on said post for movement of said locking members through said recesses as said post is received through said hole, said locking members, upon engagement through said recesses and a rotational movement of said handle to said first and second positions, overlying said first end of said handle to preclude withdrawal of said first end of said handle from said post.

8. The container of claim 7 wherein said recesses are axially aligned with the length of said handle, said snap-engaging lugs comprising a pair of handle lugs adjacent each recess, the handle lugs of each pair being in parallel opposed relation to each other to each side of the corresponding recess, and a single post lug integral with said post and positioned for alignment with the length of said handle in said first and second positions thereof, said post lug extending laterally from said post, said projecting locking members on said post being diametrically aligned to the opposite sides of said post and at substantially right angles to said post lug for engagement with said handle first end transversely of the length of said handle in each of said first and second positions.

9. The container of claim 8 wherein said first end of said handle is of a generally annular configuration with a substantially concave recessed outer face.

10. The container of claim 8 including a cover selectively receivable in said upper end portion of said container body through said mouth, said upper end portion of said body having an outwardly formed convex portion diametrically opposed from said post and defining a pouring spout, said cover including a laterally extending tab selectively alignable over said spout, and cooperating thread means on said cover and said upper end portion for engaging said cover to said upper end portion with said tab closing said spout in a fully seated position of said cover within said upper end portion, said threads comprising a single partial flight within said upper end portion of said body and a multiple flight thread on said cover, each thread having a single lead-in end portion positioned to bring the tab into direct overlying relation to said spout upon a full seating of said cover.

11. The container of claim 10 wherein said cover has a concave outer face with a central domed portion and radial grasping fins extending from said central domed portion to the outer extremities of said cover concave face.

12. The container of claim 5 wherein said post extends from said upper end portion of said container body at an angle of approximately 29° to a plane defined by the mouth of said container, said arcuate central portion of said handle being defined on a radius of approximately 72°.

13. The container of claim 1 including means for selectively and releasably locking said post-engaging first end of said handle to said post in said first and second positions of said handle, and means on said post and said post-engaging end of said handle for selectively engaging and releasing said post-engaging end with and from said post at an intermediate position between said first and second positions.

14. The container of claim 13 wherein said means for locking said first end of said handle to said post comprises snap-engaging lugs on said post and on said first end of said handle, said lugs snap-engaging and releasable locking said handle in said first and second positions as said handle is manually moved into said positions.

15. The container of claim 14 wherein said means for selectively engaging and releasing said first end with and from said post comprises a central opening through said first end of said handle for receiving said post axially therethrough, said post having an outer end portion with laterally outwardly extending locking members thereon, said opening through said first end of said handle having laterally outwardly extending recesses selectively alienable with said locking members on said post for movement of said locking members through said recesses as said post is received through said hole, said locking members, upon engagement through said recesses and a rotational movement of said handle to said first and second positions, overlying said first end of said handle to preclude withdrawal of said first end of said handle from said post.

16. The container of claim 15 wherein said recesses are axially aligned with the length of said handle, said snap-engaging lugs comprising a pair of handle lugs adjacent each recess, the handle lugs of each pair being in parallel opposed relation to each other to each side of the corresponding recess, and a single post lug integral with said post and positioned for alignment with the length of said handle in said first and second positions thereof, said lug on said post extending laterally therefrom, said projecting locking members on said post being diametrically aligned to the opposite sides of said post and at substantially right angles to said post lug for engagement with said handle first end transversely of the length of said handle in each of said first and second positions.

17. The container of claim 4 wherein said post extends from said upper end portion of said container body at an angle of approximately 29° to a plane defined by the mouth of said container, said arcuate central portion of said handle being defined on a radius of approximately 72°.

18. The container of claim 1 including a cover selectively receivable in said upper end portion of said container body through said mouth, said upper end portion of said body having an outwardly formed convex portion diametrically opposed from said post and defining a pouring spout, said cover including a laterally extending tab selectively alignable over said spout, and cooperating thread means on said cover and said upper end portion for engaging said cover to said upper end portion with said tab closing said spout in a fully seated position of said cover within said upper end portion, said threads comprising a single partial flight within said upper end portion of said body and a multiple flight thread on said cover, each thread having a single lead-in end portion positioned to bring the tab into direct overlying relation to said spout upon a full seating of said cover.

19. The container of claim 18 wherein said cover has a concave outer face with a central domed portion and radial grasping fins extending from said central domed portion to the outer extremities of said cover concave face.

* * * * *